United States Patent [19]

Stritzl et al.

[11] Patent Number: 4,647,065

[45] Date of Patent: Mar. 3, 1987

[54] SAFETY SKI BINDING

[75] Inventors: Karl Stritzl; Henry Freisinger, both of Vienna; Franz Luschnig, Traiskirchen; Johann Zotter, Vienna, all of Austria

[73] Assignee: TMC Corporation, Baar, Switzerland

[21] Appl. No.: 727,505

[22] Filed: Apr. 26, 1985

[30] Foreign Application Priority Data

Apr. 26, 1984 [AT] Austria ..... 1383/84

[51] Int. Cl.[4] ..... A63C 9/081

[52] U.S. Cl. ..... 280/618; 280/624

[58] Field of Search ..... 280/618, 620, 617, 628, 280/632, 631, 611, 624

[56] References Cited

U.S. PATENT DOCUMENTS

| | | | |
|---|---|---|---|
| 3,740,064 | 6/1973 | Weg | 280/624 |
| 4,113,276 | 9/1978 | Kirsch | 280/618 |
| 4,266,806 | 5/1981 | Weigl | 280/633 |
| 4,336,955 | 6/1982 | Schmidt | 280/618 |
| 4,479,664 | 10/1984 | Gertsch | 280/618 |
| 4,561,672 | 12/1985 | Spitaler | 280/618 |

FOREIGN PATENT DOCUMENTS

| | | | |
|---|---|---|---|
| 374695 | 10/1983 | Austria | 280/624 |
| 2836481 | 8/1978 | Fed. Rep. of Germany | 280/624 |

*Primary Examiner*—David M. Mitchell

*Attorney, Agent, or Firm*—Flynn, Thiel, Boutell & Tanis

[57] ABSTRACT

A safety ski binding having a plate which is rotatably supported for movement about a ski fixed vertical axle. The plate has a front and a rear clamping device for a ski shoe thereon. The rear clamping device, namely, a releasing heel holder, is provided with a pair of sole down-holding members. At least one of the two, preferably both, sole down-holding members are pivotally supported for movement in transverse directions of the ski by bearings on a stepping plate hingedly supported on the heel holder. A releasable locking device is provided for fixing the sole down-holding members in their position holding the shoe in the skiing position. The releasable locking device is releasable against the force of at least one spring and is engaged by a control part.

16 Claims, 5 Drawing Figures

SAFETY SKI BINDING

FIELD OF THE INVENTION

The invention relates to a ski binding comprising a plate rotatably supported about a ski-fixed vertically upright axle constructed for example as a bolt, which plate has a front and a rear clamping device for a ski shoe, whereby the rear clamping device, namely, a releasing heel holder, is provided with a laterally spaced sole down-holding mechanism.

BACKGROUND OF THE INVENTION

Such ski bindings, socalled midpoint ski bindings, have certain advantages compared with bindings having a jaw-heel system. Among others, the friction forces occurring during a horizontal release operation are substantially reduced, since the plate is arranged for movement about a ski-fixed axis of rotation and has to overcome a substantially smaller amount of friction than is the case with a ski shoe clamped between a heel holder and a front jaw and slides on the upper side of the ski. Furthermore, release moments which are independent of torque can be controlled with such bindings, since the distance from the front and rear clamping device to the center of rotation is the same in each case, whereby standardized shoe soles or plates on shoe soles are secured between the front and rear clamping device.

The release operation during a horizontal release is accomplished usually in such binding systems by a feeler mechanism measuring the amount of swivelling of the plate relative to the ski or the amount of torque which is created thereby, forwarding this information to the heel holder so that it releases beginning at a specific horizontal torque and releases the ski shoe upwardly when also a vertical moment occurs.

This type of release functions only as long as a vertical moment simultaneously exists. However, if due to a special type of fall a vertical moment does not exist, it can happen that the binding does not release the shoe in spite of a dangerous horizontal moment and thus does not preclude the danger of injury to the skier.

The purpose of the invention is now to provide a ski binding of the above-mentioned type, which upon an overload releases satisfactorily both vertically and also horizontally, whereby no vertical moments whatsoever must be needed to effect a horizontal release.

This purpose is attained by the invention for the first time by at least one of the two, preferably both, sole down-holding means being supported for pivotal movement in a transverse direction of the ski by means of bearings on a stepping plate which is hingedly connected to the heel holder and being fixed in their position holding the shoe in the skiing position by a locking member which can be released against the force of at least one spring and is engaged by a control part.

The invention makes it possible for the first time to release a ski binding vertically and horizontally with a plate which is rotatably supported about a ski-fixed axis of rotation, without requiring a vertical moment during the horizontal release.

The front clamping device can thereby be rigid or can have any desired form of conventional clamping devices.

For an optimum guiding of the shoe or the plate by the heel holder, it is provided inventively that the sole down-holding means have a gripping means mechanism, which grip, viewed in the longitudinal direction of the ski both laterally and also frontally at least at one point around corresponding points of engagement of the shoe or of a further plate on the shoe.

According to a development of the invention, each bearing is formed by an axle which is fixedly connected to the stepping plate, which makes it possible for the sole down-holding means to be able to follow the vertical elasticity of the heel binding.

The locking member is for the same reason also supported at least on one axis which is connected fixedly to the same stepping plate. The locking member is a bracket-shaped structural part.

According to a development of the invention, the ends of the bracket of the bracket-shaped structural part engage in their locked position of the sole down-holding means in correspondingly constructed receiving points thereon. It is preferable for the locking member to have an extent which is oriented substantially transversely with respect to the longitudinal direction of the ski and have at least one prong, so that the outer areas are formed by the bracket ends and the prong represents a point of engagement for the control part, and so that the prong can be disengaged from the control part during a vertical release by a lifting of the stepping plate. A structural part which is easy to manufacture is provided for the locking member in an advantageous manner by this development.

According to a further development of the invention, the control part is designed in two parts, the one part of which grips behind the prong by means of a hook and the other part of which engages a skifixed part. Each relative movement of the plate with respect to the ski thus results in a movement of the control part, which causes the locking member to be swung in a direction toward a release position. The control part can by itself also be divided in two at its side which projects from the locking member, so that both parts are constructed as projecting hooks and each engage a skifixed part. This special development of the invention assures in a simple manner a safe movement in both directions of rotation of the plate. The control part is thereby preferably supported in the plate and can thereby by all means be designed as a flat slide-member part.

A simplification in the construction results by fixedly arranging each skifixed part on a flangelike mounting on the vertically upright axis of the plate. For returning the control part it is provided that the hooks are biased by a further spring acting in the direction of the locking member to cause the sole down-holding parts to be locked again in a self-regenerating manner by swinging back following a release operation.

In order to fulfill the function of optimizing the separation between the heel-releasing mechanism and the horizontal-releasing mechanism it is furthermore provided that the prong projects downwardly and has a bent section against the direction of swing of the stepping plate, which bent section is designed preferably circularly, so that the midpoint of the radius lies at the centerline of the axis which supports the stepping plate.

The anchoring of the locking member is inventively assured simply and safely by the locking member having three prongs, whereby the prongs which flank the center prong also project downwardly and these two each receive a pivot pin which is supported in a downwardly projecting support arm on the stepping plate.

The self-regenerating of the sole down-holding parts is securely assured by a further development of the invention by urging these parts into the clamping position by the use of springs, preferably torsion springs.

In order to prevent a possible jamming of the locking device with the corresponding points of engagement in the sole down-holding means, according to a special development of the invention, it is provided that the sole down-holding means having sliding extensions which project toward the center of the ski and which are arranged at the height of the bracket ends and have a curvature having an approximately constant radius with respect to the swivel axis of the sole down-holding parts, the sliding extensions lie in one plane with the edge of the corresponding receiving points. The sliding extensions each preferably have a projection located at their ends remote from the sole down-holding means, which projections determine the extent of their pivoting movement, which is important after a horizontal release, since the projections prevent a possible damage to these parts, for example, by an excessive jamming thereof into the slope.

According to a further advantageous development of the invention, the stepping plate has a cam on its underside, which cam cooperates with a control cam, which through a slide member loads a third spring which influences the release force. The control cam is fixedly connected to a release lever for the voluntary release of the binding. The structural height of the heel holder is maintained low through this measure and furthermore a simple construction integration of the release mechanism of the heel binding into the plate or under the stepping plate of the heel binding is made possible.

BRIEF DESCRIPTION OF THE DRAWINGS

The invention is discussed in greater detail with reference to the drawings which illustrate one exemplary embodiment. More particularly, and in the drawings.

DETAILED DESCRIPTION

Figure 1:
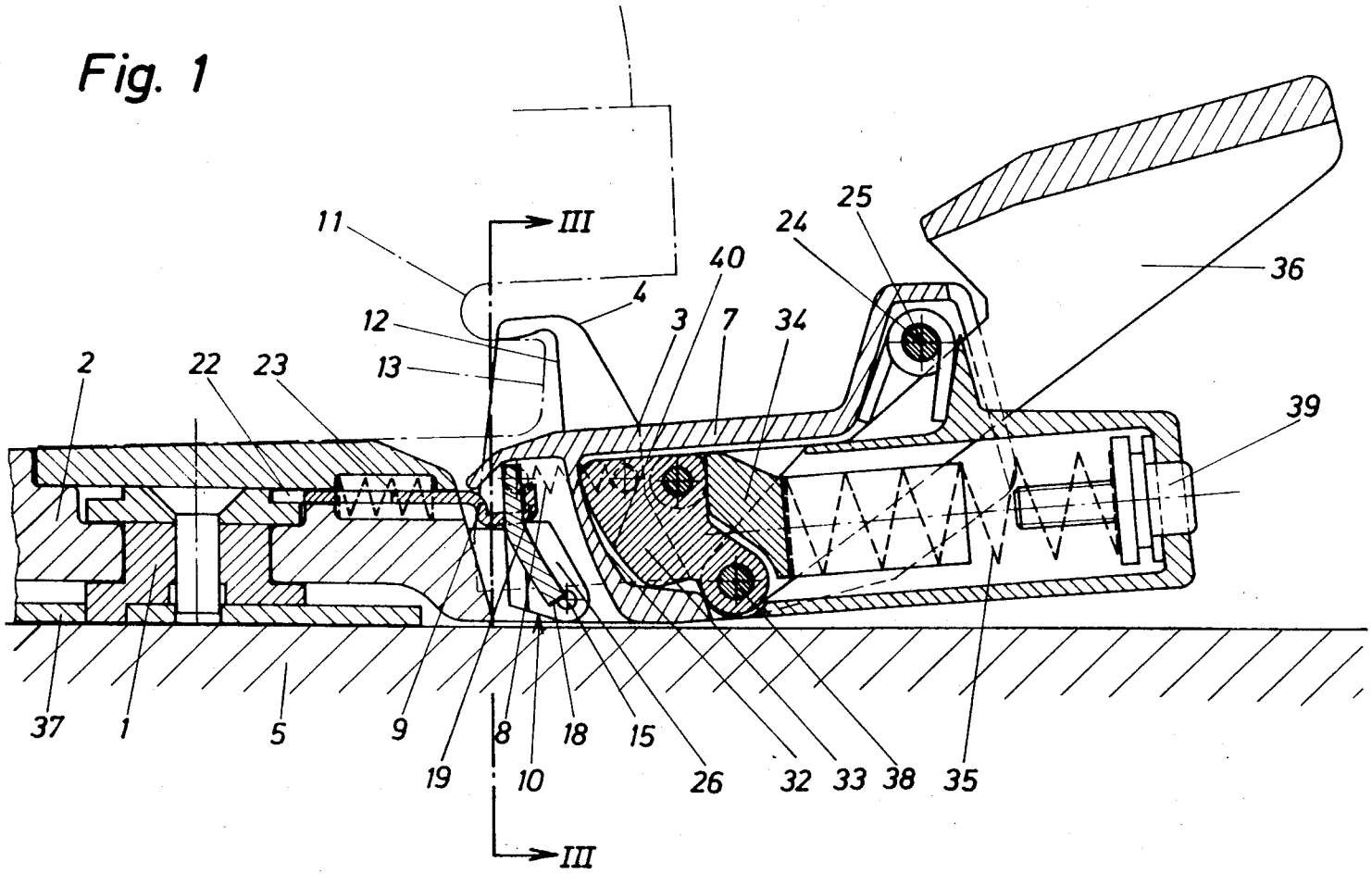
FIG. 1 is a central longitudinal cross-sectional view of a heel portion of a plate binding.

The binding consists substantially of a base plate 37 secured to the ski 5 and which has fixedly supported thereon a vertically upright axle 1 in the form of a bolt. A plate 2 is rotatably supported on the vertical axle. A heel holder is fixedly connected to the plate 2 and includes a stepping plate 7 which is pivotally connected thereto for movement about an axle 25. The stepping plate 7 carries on both sides thereof a sole down-holding means 4 defining gripping means 12 which both frontally and also laterally hold the shoe 11 in the skiing direction and 13 thereon which is constructed to correspond with the opening or pocket in the gripping means 12. The stepping plate 7 has a downwardly projecting cam 32 which is engaged by a control cam 33 fixedly connected to release lever 36. The control cam 33 is pivotally connected to a swivel axle 38 on the heel holder 3. The side of the control cam 33 which is remote from the cam 32 is engaged by a piston 34 urged thereagainst by the force of a spring 35. The spring 35 is, like in common heel holders, housed in the housing of the heel holder 3 and has an initial tension adjusting device 39 supported against the housing. If the release lever 36 is now pressed downwardly, then the control cam 33, rigidly connected to the release lever 36, swings upwardly and grips thus under the underside of the stepping plate 7. Caused by the cam 32, the control cam 33 is urged around its axle 38 against the piston 34 and the force exerted thereon by the spring 35 due to a compressing thereof. The cam 33 has a control surface 40 thereon which conforms to the surface of the cam 32, on which control surface the cam 32 slides upwardly until it becomes disengaged from the control cam 33 to cause the sole down-holding means 4 to snap off and thus the ski shoe 11 to be released. During an automatic release of the heel holder, the ski shoe connection to the sole down-holding means 4 causes the cam 32 to be pulled upwardly along with the stepping plate 7 to the same snap-off point by the shoe 11.

Figure 2:
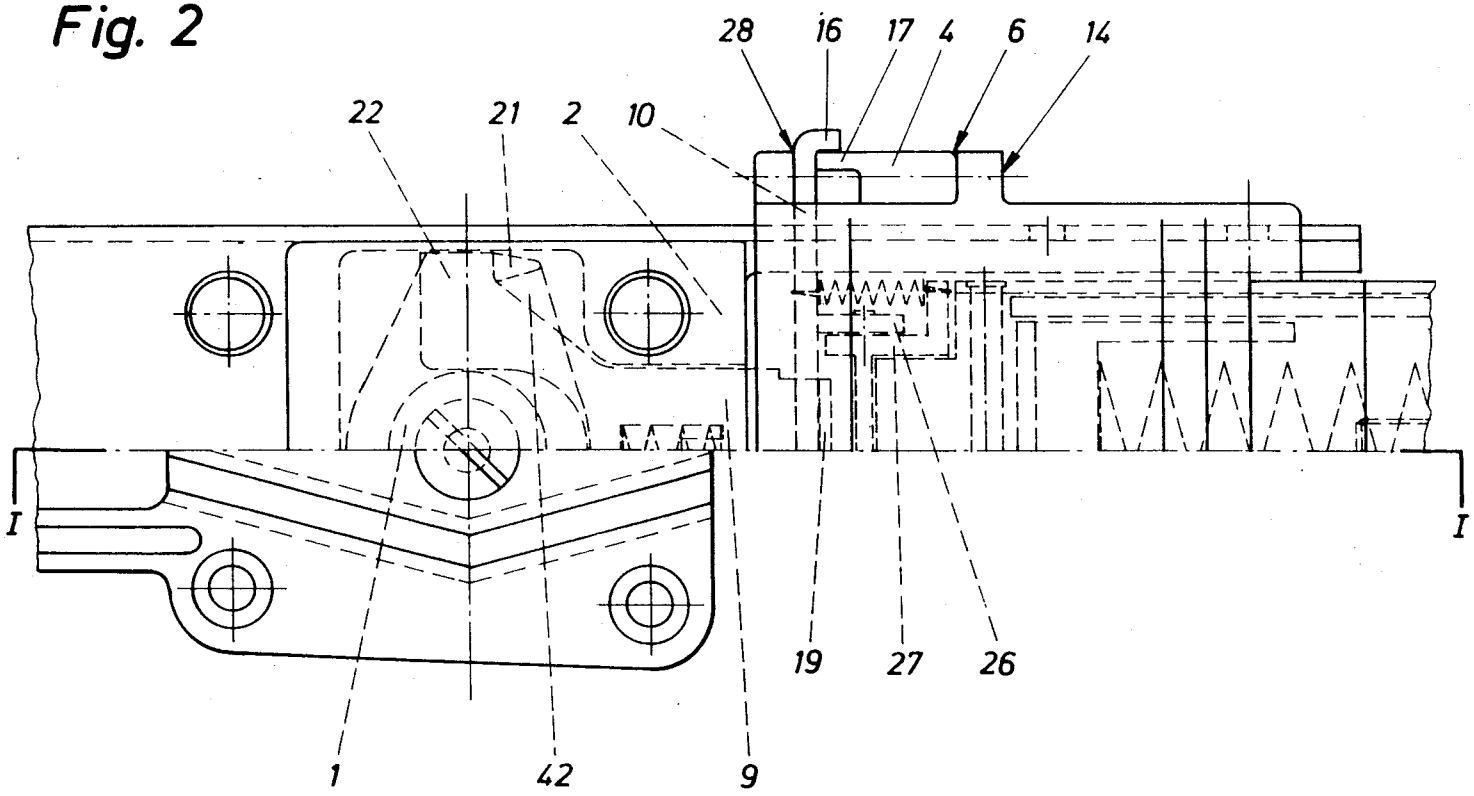
FIG. 2 is a top view of one half of the same portion illustrated in FIG. 1.
Figure 3:
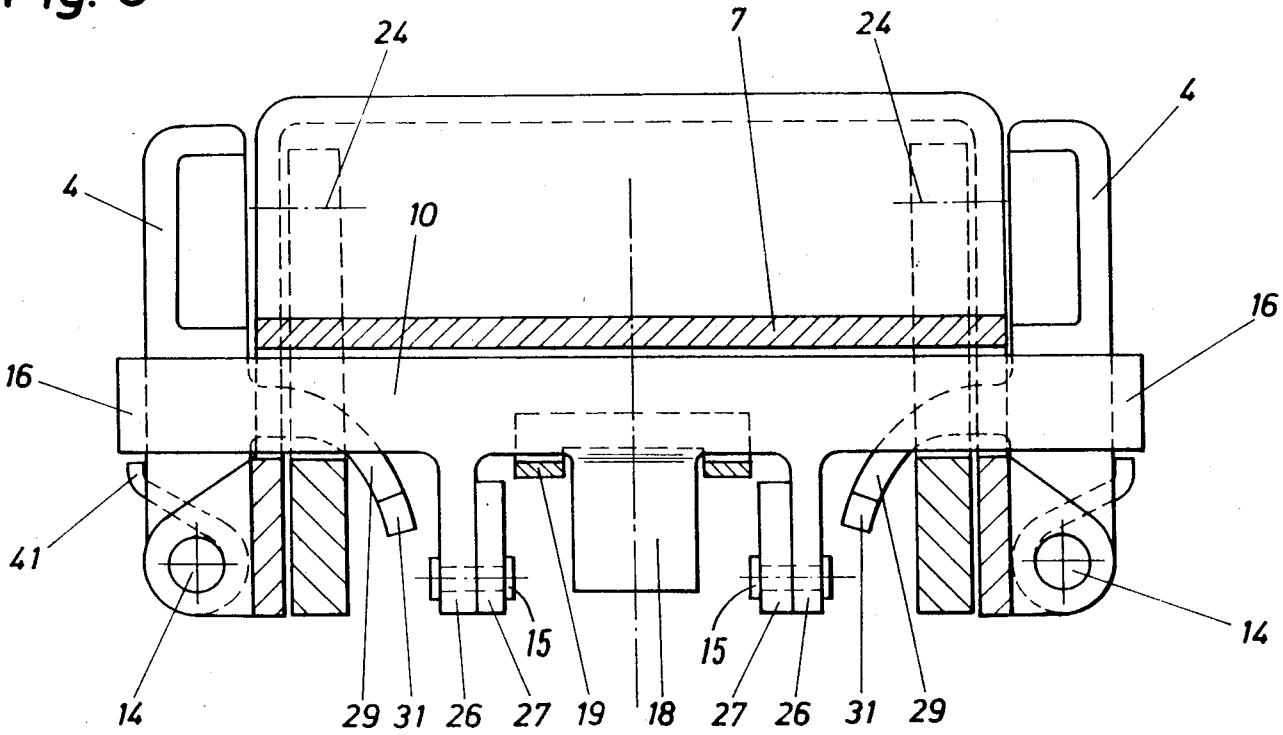
FIG. 3 is a cross-sectional view taken along the line III—III of FIG. 1.

A torsion release of the binding is caused by a rotation of the plate 2 about the axis of the vertical axle 1. A control part 9, which is supported in the plate 2 and is held by a spring 23 in the initial position thereof, is thereby pulled in the skiing direction of the ski because a hook 22 thereon is engaged with an engagement part 21 fixedly connected to the vertical axle 1. The control part 9 is constructed hook-shaped at the other end, as at 19. The hook 19 extends upwardly and grips behind a locking member 10, which first in a not illustrated manner prevents the sole down-holding means 4 from pivoting. The locking 10 has vertically upright prongs 26 which are pivotally supported on a stepping-plate-fixed part 27 by means of a pivot pin 15 (see in particular FIG. 3). Hence, the stepping plate 7 carries the locking member 10. The locking member 10 is urged to a locking relation with the sole down-holding means 4 by means of a spring 8, namely, in a direction opposite to the skiing direction about the axis of the pivot pin 15. Thus, in the case of a torsion force acting about the vertical axle 1, the control part 9 with its hook 19 is pulled in the skiing direction to cause the locking member 10 to be pulled also in the skiing direction about the axis of the pivot pin 15 against the force of the spring 8. As soon as the locking member 10 has moved in this direction a certain distance, the locking member 10 becomes disengaged at the not illustrated points from the sole-down means 4 to cause these in turn, corresponding with the torsion moment, to open up laterally to release the ski shoe 11 therefrom. The hook 19 of the control part 9 preferably has a recess into which is received a prong 18 on the locking member 10. The prong 18 should be always in contact with the hook 19, because any torsion about the vertical axle 1 should result in a swivel of the locking member 10. The prong 18 is therefore bent toward the tail of the ski so that a radius is provided for the bent section, which radius has its center 24 in the axis 25 of the stepping plate 7. Elasticity in the vertical direction is assured at the same time during a torsion load by the bent prong 18, since the prong 18 slides along the hook 19 and same thus continues to engage the locking member 10. The locking member 10 has bracket-shaped ends 16 at opposite ends thereof, which laterally grip around the sole down-holding means 4 and thus prevents them from swinging open. The sole down-holding means 4 are pivotally supported on axles 14 which extend in the longitudinal direction of the ski and are secured to the stepping plate. Torsion springs 41 urge the sole down-holding means 4 in a direction toward the stepping plate. As can be seen from FIG. 2, the control part 9 grips with hooks 22 around the fixed parts 21 arranged on a flange mounting 42 which is fixedly connected to the vertical axle 1. The control part 9 is reciprocally supported on the plate 2 and is therefore during a pivoting of the same about the vertical axle 1 pulled in the skiing direction by one of the fixed parts 21. The hook 19 of the control part 9 pulls through the aforesaid movement the locking member 10 also in the skiing direction until the bracket ends 16 become disengaged from the sole down-holding means 4, or from the correspondingly formed receiving points 17 thereof. If the locking member 10 is out of engagement with the sole down-holding means 4, then the sole down-holding means 4 can pivot laterally against the force of the torsion springs 41. As can be seen from FIG. 3, the sole down-holding means 4 have sliding webs 29 connected integrally therewith, which sliding webs 29 each have a projection 31 thereon. The function of the webs 29, 29 is to engage the bracket ends 16 following a swinging out of the sole down-holding parts 4 to thereby make it possible for the bracket ends 16 to slide on the webs 29 up to the projections 31. The projections 31 prevent a further swinging out of the sole down-holding means 4. The sliding of the bracket ends 16 on the webs 29 prevents a snapping back of the locking member 10 in a manner which is not operatively at a safe point in time, namely at a point in time whereat the torsion forces which led to the twisting release have dissipated.

Figure 4:
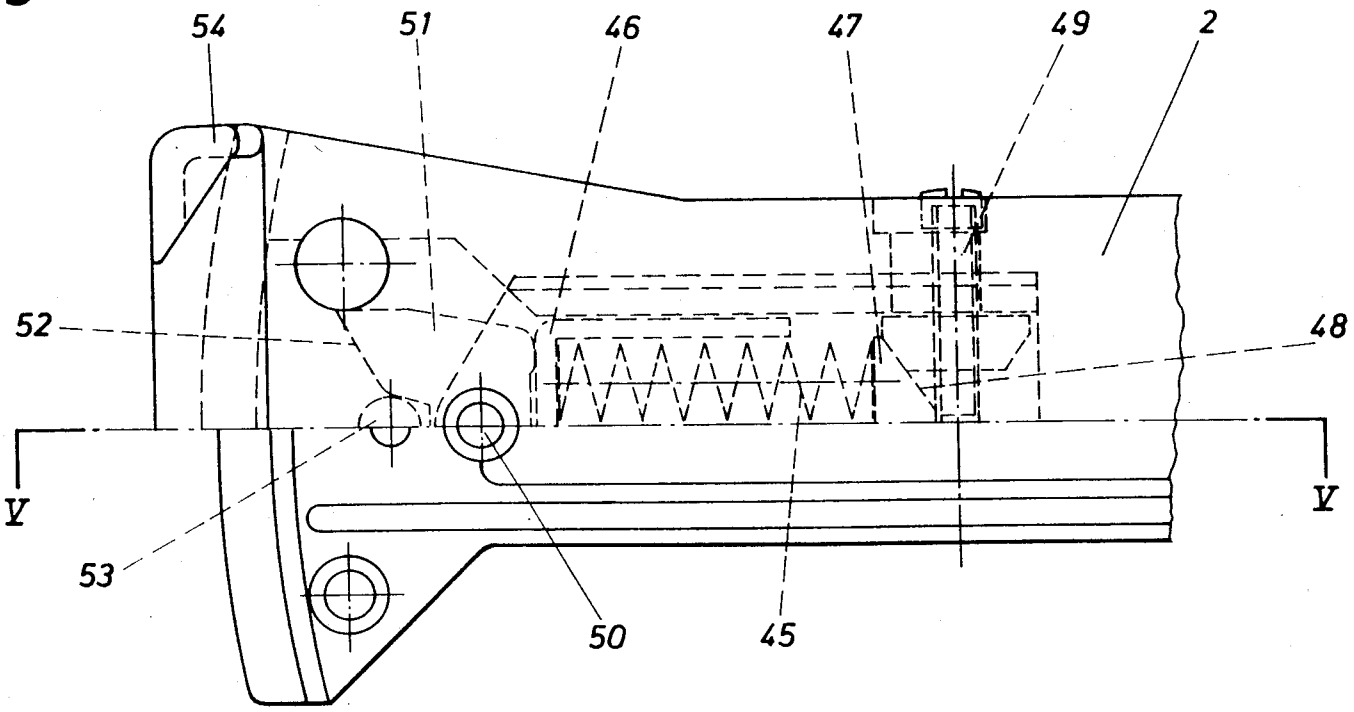
FIG. 4 is a top view of an embodiment of the jaw region of the binding.
Figure 5:
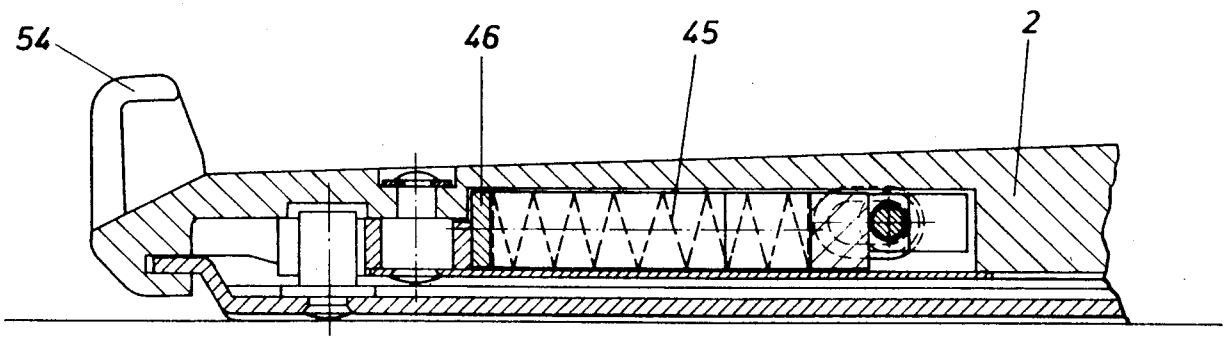
FIG. 5 is a sectional view taken along the line V—V of FIG. 4.

FIGS. 4 and 5 illustrate one of many possible modifications of the jaw fastener and a torsion moment adjustment or measurement structure associated therewith. A further spring 45 is supported in the plate 2, which spring 45 is supported at one end against a piston 46 and at the other end against a spring abutment 47. The spring abutment 47 has a conical surface 48 thereon and on a side thereof remote from the spring. A cone having centrally a threaded opening therethrough with an adjusting screw 49 received therein abuts against the conical surface 48. The axis of the screw 49 extends perpendicularly to the longitudinal axis of the ski. If one rotates the adjusting screw 49, then the cone moves axially of the screw to effect a change in the initial tension of the spring 45. The piston 46 is engaged by a cam 51 which is pivotally supported for movement about an axle 50. The cam 51 has a rocker arm 52 on its end remote from the piston 46, which rocker arm 52, caused by the force of the spring 45, is pressed against a control bolt 53 which is fixed on the base plate. The form of the rocker arm 52 is thereby approximately V-shaped with the tip of the V extending toward the tail of the ski.

In the case of a torsion moment acting onto the plate 2, the rocker arm 52 is now moved along the control bolt 53, which causes the rocker arm to pivot about the axle 50 and thus effect the movement of the piston 46 toward the tail of the ski, which causes the spring 45 to be further compressed. The front sole down-holding means 54 is connected in one piece and nonmovably to the plate 2.

The principle in regard to the function of the binding will again be briefly discussed in summary:

A vertical release occurs through a force transfer of the ski shoe sole (which can for example also be a further plate which is secured to the sole) through the gripping means 12 of the sole down-holding means 4 onto the stepping plate 7, which stepping plate 7 is pivoted upwardly against the force of the spring 35 about its axis of rotation 25 until the control cam 33 which is engaged by the spring 35 becomes disengaged from the cam 32, which, as stated above, is connected in one piece to the stepping plate 7.

The horizontal release occurs through the force transfer of the shoe 11 onto the sole down-holding means 4 or 54, which causes the plate 2 to be rotated against the force of the spring 45. By rotating the plate 2, the control part 9, which engages at least one ski-fixed part 21, is pulled in the skiing direction so that its hook 19 effects a disengagement of the locking member 10, which heretofore fixed the sole down-holding means 4, from the sole down-holding means and the ski shoe sole is thus released.

The embodiments of the invention in which an exclusive property or privilege is claimed are defined as follows:

1. A safety ski binding for releasably securing a ski shoe to a ski, comprising:

a vertical upright first axle on said ski;

an elongated plate means rotatable supported on said first axle, said plate means having longitudinally spaced front and rear clamping devices for holding said ski shoe thereto, said first axle being located intermediate said front and rear clamping devices, said rear clamping device including a stepping plate and pivot means for pivotally securing said stepping plate to a rear end portion of said plate means and for movement about a second axle extending transversely of said longitudinal axis, said stepping plate having a pair of sole down-holding means thereon symmetrically disposed on opposite sides of a longitudinal axis of said stepping plate means for holding down a heel of said ski shoe;

support means for pivotally supporting each of said sole down-holding means on said stepping plate for movement in a transverse direction outwardly of said plate means about a third axle extending parallel to said longitudinal axis of said plate means and between a ski shoe holding position and a ski shoe releasing position; and releasable locking means for locking said pair of sole down-holding means in said ski shoe holding position and for unlocking said pair of sole down-holding means and allowing lateral outward movement thereof about said third axle in response to a pivotal movement of said plate means about said first axle, said releasable locking means including a locking member for blocking lateral outward movement of each said sole down-holding means, and control means for effecting a removal of said blocking relation between said locking means and each said sole down-holding means in response to a pivoting of said plate means about said first axle beyond a predefined angular relation between a longitudinal axis of said ski and said longitudinal axis of said plate means, an upward pivoting of said stepping plate relative to said plate means also effecting an upward movement of said sole down-holding means and a release of said ski shoe but without removal of said blocking relation.

2. The binding according to claim 1, wherein each said sole down-holding means has grippiing means thereon for gripping both laterally and frontablly at least at one point around corresponding points of engagement on said ski shoe.

3. The binding according to claim 1, wherein said releasable locking means include a cam surface on said stepping plate and a control cam engaging said cam surface, a slide member engaging said control cam, and a spring urging said slide member into engagement with said control cam to influence the release force of said ski binding, and a release lever connected to said control cam for facilitating a voluntary release of said ski binding.

4. The binding according to claim 1, wherein said locking member is pivotally supported on at least one further axle on said stepping plate.

5. The binding according to claim 4, wherein said locking member has bracket end means thereon for engaging and holding said sole down-holding means in said ski shoe holding position.

6. The binding according to claim 1, wherein said locking member extends transversely with respect to said longitudinal axis of said ski and has at least one downwardly projecting prong, said control means operatively engaging lateral edges of said prong during pivotal movement of said plate means about said first axle, said control means becoming disengaged from said prong during a vertical upward pivoting of said stepping plate.

7. The binding according to claim 1, wherein said control means includes a longitudinally extending member, one end of which is hook shaped to grip behind said prong and the other end of which is also hook shaped to engage a ski-fixed part in response to said pivotal movement of said plate means about said first axle.

8. The binding according to claim 7, wherein said other end of said elongated member is bifurcated with each bifurcation being hook shaped and engaging said ski-fixed part in response to a pivoting of said plate means about said first axle.

9. The binding according to claim 7 wherein said elongated member is supported on said plate means.

10. The binding according to claim 8, wherein said ski-fixed part is a flange-like member encircling said first axle of said plate means.

11. The binding according to claim 10, including a spring for continually urging said bifurcations into engagement with said flangelike member so that a pivoting movement of said plate means about said first axle will cause said elongated member to move longitudinally of said plate means.

12. The binding according to claim 6, wherein said prong is arcuately curved having a radius the centerline for which coincides with said second axle.

13. The binding according to claim 6, wherein said locking member has additional prongs straddling said downwardly projecting prong which is centrally located, said additional prongs also projecting downwardly and support a pivot pin to pivotally secure said additional prongs to a support arm on said stepping plate.

14. The binding according to claim 1, including torsion springs for continually urging said sole down-holding means into said ski shoe holding position.

15. The binding according to claim 4, wherein said sole down-holding means each have sliding webs which project toward the longitudinal center of said ski, said sliding webs being arranged at a level corresponding to a level of said bracket end means and have a curvature with a radius corresponding with said third axle for said sole down-holding means.

16. The binding according to claim 15, wherein said sliding webs each have a projection thereon at their ends remote from said sole down-holding means, said projections engaging said stepping plate to limit the extent of their movement.

* * * * *